United States Patent [19]

Poehlman

[11] 4,453,523

[45] Jun. 12, 1984

[54] PRESSURE BALANCED FLOW REGULATOR FOR GASEOUS FUEL ENGINE

[75] Inventor: Arthur G. Poehlman, Oconomowoc, Wis.

[73] Assignee: Outboard Marine Corporation, Waukegan, Ill.

[21] Appl. No.: 355,914

[22] Filed: Mar. 8, 1982

[51] Int. Cl.[3] ..... F02B 43/00; F02M 21/04

[52] U.S. Cl. ..... 123/527; 123/525; 123/575; 48/180 R; 48/189; 48/184

[58] Field of Search ..... 123/525, 526, 527, 575; 48/180.1, 184, 189.1

[56] References Cited

U.S. PATENT DOCUMENTS

| | | | |
|---|---|---|---|
| 2,409,611 | 10/1946 | Bodine | 123/527 |
| 2,754,185 | 7/1956 | Ensign | 48/184 |
| 2,896,599 | 7/1959 | Ensign | 123/527 |
| 2,962,366 | 11/1960 | Oosterdijk | 48/184 |
| 3,009,794 | 11/1961 | Barfod | 48/184 |
| 3,068,085 | 12/1962 | Ensign et al. | 48/184 |
| 3,068,086 | 12/1962 | Ensign et al. | 123/527 |
| 4,352,677 | 10/1982 | Jones | 48/184 |

*Primary Examiner*—Charles J. Myhre
*Assistant Examiner*—E. Rollins Cross
*Attorney, Agent, or Firm*—Michael, Best & Friedrich

[57] ABSTRACT

Disclosed herein is a gaseous fuel and air supply system for an internal combustion engine, which system comprises an air-fuel mixing chamber, an air supply duct communicating with the mixing chamber and with the atmosphere and including a sensing tap, a flow control valve adapted to communicate with a source of pressurized gas, being operable between open and closed positions, and being biased toward the closed position, a fuel supply duct extending between the flow control valve and the mixing chamber and including a sensing tap, and an actuator communicating with the sensing tap in the air supply duct and with the sensing tap in the fuel supply duct for controlling operation of the flow control valve between the open and closed positions.

10 Claims, 2 Drawing Figures

261
141
111
109
43
PRESSURIZED GASEOUS FUEL SOURCE
139
96
121
125
91
97
95
151
51
67
47
69
149
65
277
275
147
73
45
49
145
273
279
301
153
271
63
291
287
281
289
283
285
295
303
293
45
155
297
17
15
17
37
31
35
33

27
13
ENGINE

PRESSURE BALANCED FLOW REGULATOR FOR GASEOUS FUEL ENGINE

BACKGROUND OF THE INVENTION

The invention relates to systems for supplying air and fuel to engines operating on a gaseous fuel.

The invention also relates to dual fuel engines wherein one of the fuels employed is a gaseous fuel.

In prior engine installations employing gaseous fuel, the pressure reducing regulators feed gas directly into a venturi in response to venturi vaccum. Such action required a large fuel nozzle in the venturi because the volume of gaseous fuel being mixed with air is about ten percent of the air flow. The large volume of the fuel flowing into the venturi also substantially reduced the venturi vacuum. To compensate for this, prior venturis were more restrictive than if gaseous fuel was not introduced into the venturi. The system disclosed hereinafter is believed to be a substantial improvement over such prior arrangements because the gaseous fuel does not enter the system at the venturi and because the balancing of the air flow and fuel flow as disclosed hereinafter maintains a more precise air-fuel ratio with consequent improvement in emission results.

Attention is directed to the following U.S. Pats.:
Bodine U.S. Pat. No. 2,409,611 issued Oct. 22, 1946;
Ensign U.S. Pat. No. 3,068,085 issued Dec. 11, 1962;
Ensign U.S. Pat. No. 3,068,086 issued Dec. 11, 1962;
Spencer U.S. Pat. No. 3,215,132 issued Nov. 2, 1965.

SUMMARY OF THE INVENTION

The invention provides a gaseous fuel and air supply system for an internal combustion engine, which system comprises an air-fuel mixing chamber, an air supply duct communicating with the mixing chamber and with the atmosphere and including sensing means, flow control means adapted to communicate with a source of pressurized gas, being operable between open and closed positions, and being biased toward the closed position, a fuel supply duct extending between the flow control means and the mixing chamber and including sensing means, and means communicating with the sensing means in the air supply duct and with the sensing means in the fuel supply duct for controlling operation of the flow control means between the open and closed positions.

In one embodiment in accordance with the invention, the means for operating the flow control means is operable to displace the flow control means toward the open position in response to a relatively increasing vacuum condition in the air supply duct and is operable to displace the flow control means toward the closed position in response to a relatively increasing vacuum condition in the fuel supply duct.

In one embodiment in accordance with the invention, the means for operating the flow control means comprises a closed chamber, a control diaphragm within the chamber dividing the chamber into a first subchamber communicating with the sensing means in the air supply duct and a second subchamber communicating with the sensing means in the fuel supply duct.

In one embodiment in accordance with the invention, the flow control means includes a valve member movable between open and closed positions and the means for operating the flow control means further includes a linkage connecting the valve member and the control diaphragm for movement of the valve member in response to movement of the control diaphragm.

In one embodiment of the invention, the system further includes a third subchamber located in one of the first and second subchambers and including a secondary diaphragm movable relative to a position operably causing the control diaphragm to close the flow control means, means biasing the secondary diaphragm toward the position, and means communicating with the third subchamber and adapted for communication with the engine intake manifold so as to displace the secondary diaphragm away from the position against the action of the biasing means in response to engine operation.

In one embodiment of the invention, the flow control means comprises a valve member movable between open and closed positions, and the means for operating the flow control means also comprises a vacuum motor connected to the valve member for displacing the valve member between open and closed positions, which vacuum motor biases the valve member to the closed position when the vacuum motor is not subject to a vacuum condition, and means for selectively applying a vacuum condition to the vacuum motor comprising a modulating valve including a flow chamber communicating with the vacuum motor, vent means communicating with the flow chamber and with the atmosphere and including vent valve means biased to a closed position, vacuum means communicating with the flow chamber and adapted for communication with an engine intake manifold and including vacuum valve means biased to a closed position, and means operably connected to the control diaphragm and to the vent and vacuum valve means for selective opening thereof in response to control diaphragm movement.

In one embodiment of the invention, the system further includes a first pressure reducing stage adapted for communication with a source of relatively high pressure gaseous fuel, and a second pressure reducing stage communicating between the first pressure reducing stage and the flow control means.

In one embodiment of the invention, the flow control means includes means for adjustable regulating the bias closing the flow control means.

In one embodiment of the invention, each of the sensing means comprises a venturi having a throat and a pressure tap communicating with the venturi throat.

In one embodiment of the invention, the system further includes a carburetor including an air induction passage having an inlet end, a venturi, and a throttle, and the mixing chamber communicates with the inlet end of the induction passage.

Other features and advantages of the embodiments of the invention will become known by reference to the following general description, claims and appended drawings.

IN THE DRAWINGS

Figure 1:
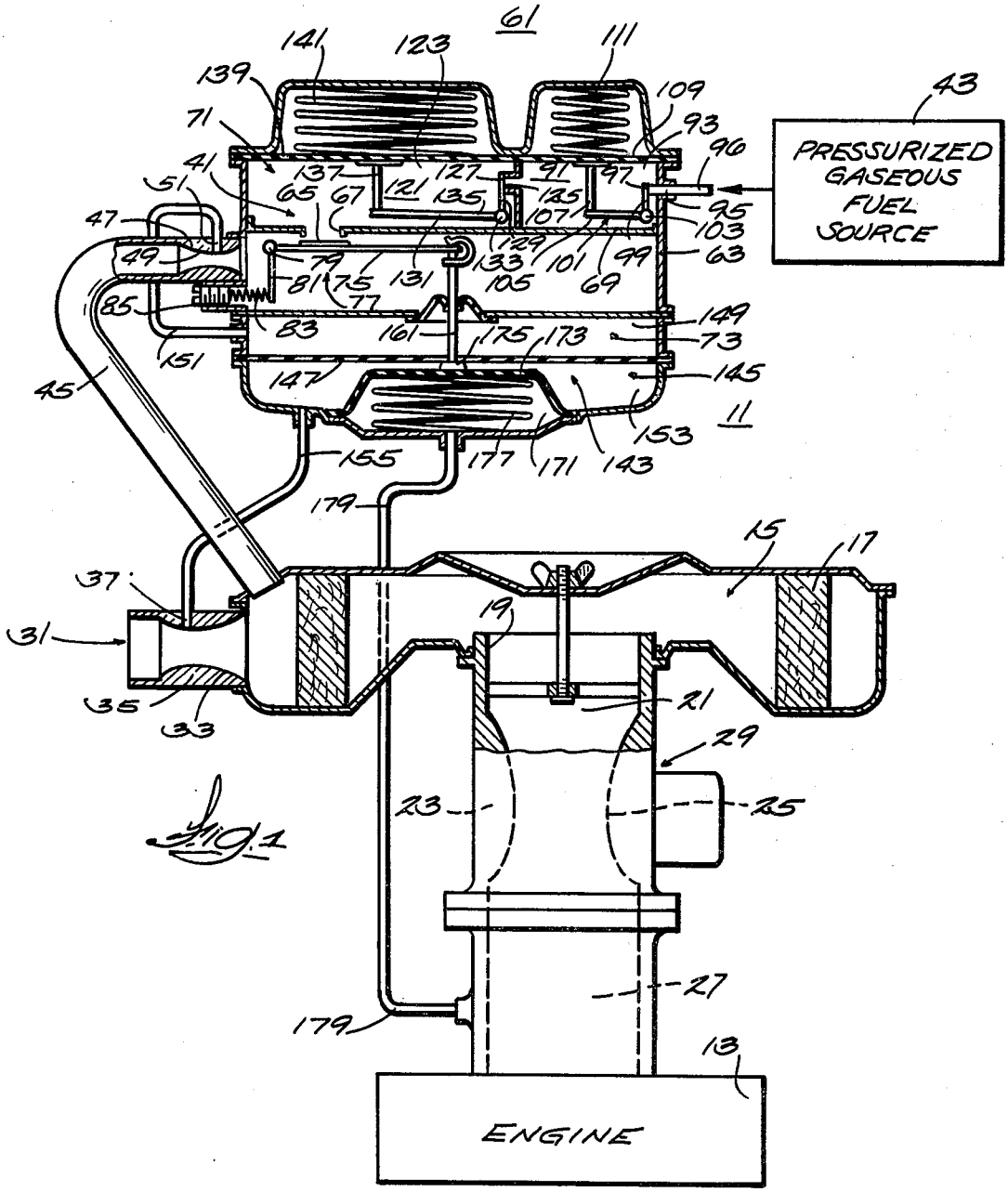
FIG. 1 is a schematic view of one embodiment of a gaseous fuel and air supply system for an internal combustion engine.

Before explaining one embodiment of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown in FIG. 1 is one embodiment of a system 11 for supplying an internal combustion engine 13 (shown schematically) with a mixture of gaseous fuel and air. The system 11 includes a fuel-air mixer or mixing chamber 15 which can include a filter 17 and which is mounted to a carburetor air inlet 19 which forms one end of an air induction passage 21 including a venturi 23 having a throat 25. In turn, the air induction passage 21 communicates through an inlet manifold 27 with the engine combustion chambers (not shown). The carburetor 29 can, if desired, include means (not shown) which is selectively operable for feeding a liquid fuel to the air induction passage 21 from a suitable source of liquid fuel.

The system 11 further includes an air supply conduit or duct 31 which communicates with the mixing chamber 15 radially outwardly of the filter 17 and which includes pressure or flow sensing means. While other constructions can be employed, in the illustrated construction, such means comprises a venturi 33 including a throat 36 having therein a pressure tap 37.

The system 11 further includes gaseous fuel flow control means 41 which communicates with a source 43 of gaseous fuel, which is operable between open and closed positions, which is biased toward the closed position, and which communicates through a fuel supply conduit or duct 45 with the mixing chamber 15 radially outwardly of the filter 17. The fuel supply duct 45 includes pressure or flow sensing means which, while other constructions can be employed, in the disclosed construction, comprises a venturi 47 including a throat 49 having therein a pressure tap 51.

More particularly, the flow control means 41 forms a part of a pressure reducing and flow controlling regulator 61 including a housing 63 and comprises a valve member 65 located in the housing 63 and movable relative to a flow control port 67 in a partition 69 dividing the housing 63 into a pressure reducing section 71 and a control section 73. While other constructions can be employed, the valve member 65 is part of a first arm 75 of a bell-crank lever 77 which is pivotally mounted at 79 and which includes a second arm 81.

The valve member 65 is biased toward the closed position by a suitable means in the form of a helical spring 83 which, at one end, bears against the second arm 81 of the bell-crank lever 77 and which, at the other end, bears against a threaded plug 85 which is threadably adjustably located in the housing 63 so as to vary the biasing force exerted by the spring 83 on the valve member 65.

The pressure reducing section 71 of the housing 63 includes a first stage reducer 91 comprising a subchamber 93 which communicates through a port 95 and a conduit 96 with the source of gaseous fuel which is under relatively high pressure. Located in the subchamber 93 is a valve member 97 which is movable, relative to the port 95, between open and closed positions and which forms a part of one leg 99 of a bell-crank lever 101 which is pivotally mounted at 103 and which includes a second leg 105 engaged by a stud or actuator 107 extending from a diaphram 109 biased by a spring 111. Accordingly, when the pressure downstream of the valve member 97 is less than a predetermined level defined by the spring 111, the valve means 95 opens to permit gaseous fuel flow into the subchamber 93 and consequent increase in pressure.

The pressure reducing section 71 of the housing 63 also includes a second stage pressure reducer 121 which includes a second subchamber 123 communicating with the previously described flow control port 67, together with a second port 125 which communicates between the first and second subchambers 93 and 123, respectively, and which is closed by a valve member 127 forming one part of one leg 129 of a bell-crank lever 131 pivotally mounted at 133. The bell-crank lever 131 also includes a second arm 135 which is engaged by a stud or actuator 137 extending from a diaphragm 139 biased by a spring 141. Accordingly, when the pressure downstream of the valve member 127 is less than a predetermined level defined by the spring 141, the valve member 127 opens to permit gaseous fuel flow into the second subchamber 123 and consequent increase in pressure.

Any suitable means can be employed to reduce the pressure of the gaseous fuel. In one embodiment, the first stage reducer 91 was connected to a source of fuel at 2400 p.s.i. The pressure in the first stage reducer 91 was 50 p.s.i. and the pressure in the second stage reducer 121 was 10 p.s.i.

The housing 63 also includes, within the control section 73, means 143 for controlling operation of the fuel flow control means 41 in response to the flow of air and gaseous fuel through the air and fuel supply ducts 31 and 45, respectively.

More particularly, in the illustrated construction, such means 143 comprises a closed control chamber 145 formed in the housing 63 below the partition 69 and including a primary or flow control diaphragm 147 which divides the control chamber 145 into an upper or fuel flow subchamber 149 which communicates through a conduit or line 151 with the pressure tap 51 in the fuel supply duct 45, and a lower or air flow subchamber 153 which communicates through a conduit or line 155 with the pressure tap 37 in the air supply duct 31.

Connected to the primary or flow control diaphragm 147 is a link or linkage 161 which is also connected to the outer end of the bell-crank lever arm 75 such that a relatively increasing vacuum condition in the lower or air flow subchamber 153, occurring in response to increasing flow in the air supply duct 31 (or a decreasing flow in the fuel supply duct 45) serves to displace the primary diaphragm 147 so as to move the bell-crank lever 77 to open the flow control port 67. On the other hand, a relatively increasing vacuum condition in the upper or fuel flow subchamber 149 occurring in response to increasing flow in the fuel supply duct 45 (or decreasing flow in the air supply duct 31) serves to displace the primary diaphragm 147 so as to move the bell-crank lever 77 to close the port 67.

Means are also provided for closing the valve member 65 when the engine 13 is not operating. More specifically, a third subchamber 171 is formed in the housing 63 and includes a flexible wall or secondary diaphragm 173 having an actuator 175 located for movement relative to a position in releasable engagement with the primary or flow control diaphragm 147 so as to displace the primary or flow control diaphragm 147 and thus the flow control valve member 65 to the closed position.

The secondary diaphragm 173 is biased toward the position closing the valve member 65 by a suitable spring 177. In addition, the third subchamber 171 communicates through a duct or line 179 with the engine inlet manifold 27 so that, during engine operation, the vacuum condition at the engine inlet manifold 27 communicates through the line 179 to the subchamber 171 so as to overcome the bias of the spring 177 and thereby to withdraw the actuator 175 from engagement with the primary or flow control diaphragm 147 through a distance sufficient to enable normal displacement of the primary or flow control diaphragm 147 in response to variation in the vacuum conditions in the fuel flow and air flow subchambers 149 and 153, respectively.

In operation, the regulator 61 provides a precise ratio of fuel flow to air flow for combustion in the engine 11 which, as indicated above, can also be operated, if desired, on a liquid fuel, such as gasoline. The venturis 33 and 47 are sized so that the vacuum signal from each is equal at the desired ratio of air flow to gaseous fuel flow. Thus, in operation, the gaseous fuel pressure is reduced by the first stage reducer 91 to about 50 p.s.i. and is further reduced to about 10 p.s.i. in the second stage reducer 121. The primary or flow control diaphragm 147 seeks a position which provides the correct ratio of fuel flow to air flow. More particularly, as air flow to the engine 11 increases, the vacuum below the primary or flow control diaphragm 147 increases and thereby opens the flow control valve member 65. The flow control valve member 1. 65 will keep opening so as to increase the gaseous fuel flow until the gaseous fuel flow venturi vacuum equals the air flow venturi vacuum. If the fuel flow should increase for any reason, the fuel flow venturi vacuum will increase and close the flow control valve member 65 until a vacuum balance is again established. As illustrated and described, the flow control valve member 65 is biased toward the closed position by the spring 83. The force of the spring 83 can be varied by adjusting the plug 85 to provide the proper idle mixture adjustment. In addition, a vacuum shutoff system is incorporated below the flow control diaphragm 147 to hold the flow control valve member 65 in closed position when the engine 11 is not running so as thereby to prevent gaseous fuel leakage.

Figure 2:
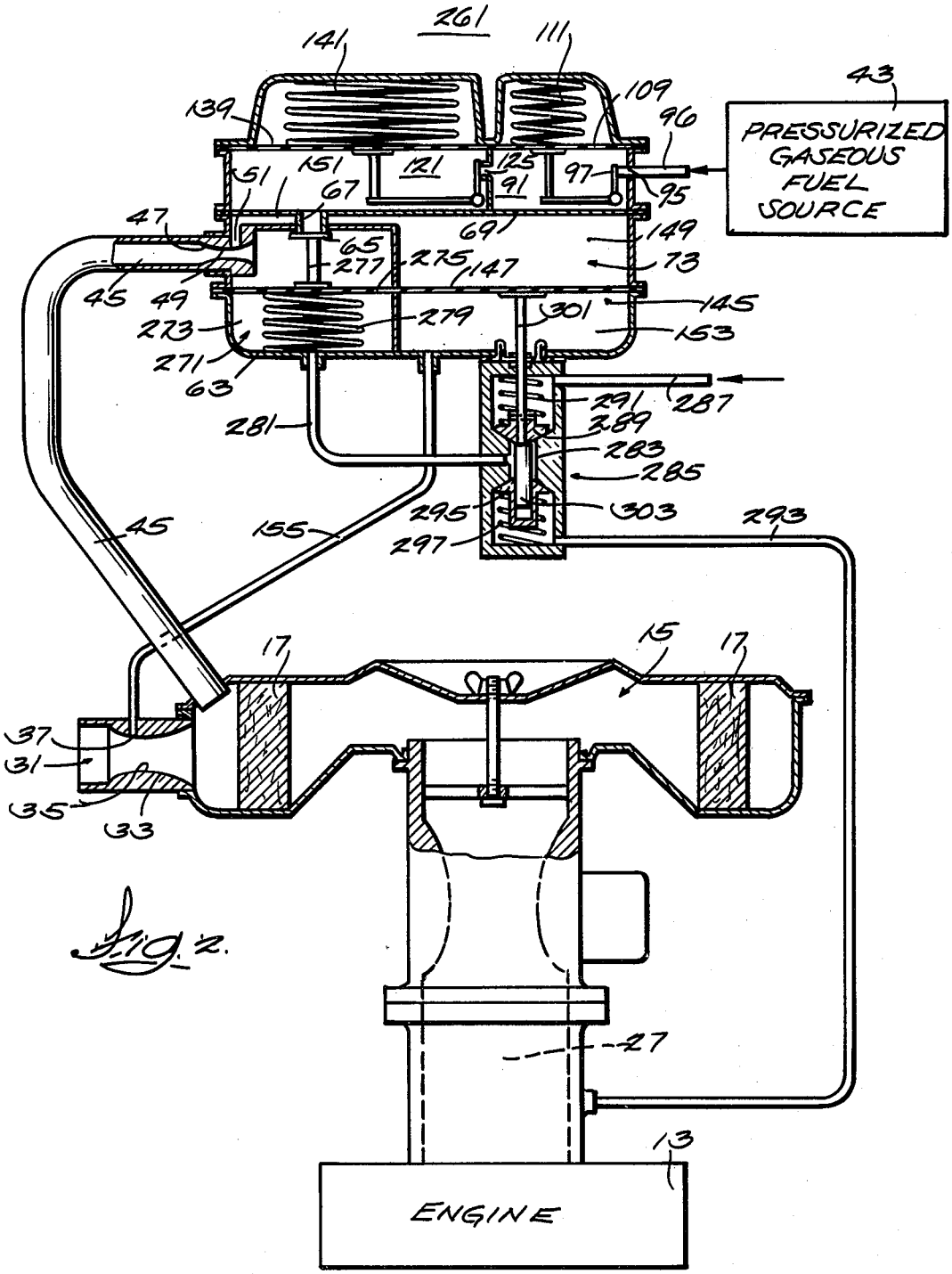
FIG. 2 is a schematic view of a second embodiment of a gaseous fuel and air supply system for an internal combustion engine.

Shown in FIG. 2 is another pressure reducing and flow controlling regulator 261 which, in part, is similar in construction to the regulator 61 shown in FIG. 1. Accordingly, components of the regulator 261 shown in FIG. 3 which are generally similar to like components of the regulator 61 shown in FIG. 1 are identified by the same reference numbers and will not be further described.

In the regulator 261 shown in FIG. 2, the control section 73 is divided into a closed control chamber 145 and a vacuum motor 271 which operates the valve member 65 between opened and closed positions relative to the main flow port 67 in the partition 69. As in the regulator 61 shown in FIG. 1, the control chamber 145 is divided by a primary or flow control diaphragm 147 into an upper or fuel flow subchamber 149 which communicates through the line 151 with the pressure tap 51 in the throat 49 of the venturi 47 in the fuel supply duct 45, and into a lower or air flow subchamber 153 which communicates through the line 155 with the pressure tap 37 in the throat 35 of the venturi 33 in the air supply duct 31.

The vacuum motor 271 comprises a closed chamber 273 including a movable wall or diaphragm 275 which, through a rod or actuator 277, displaces the valve member 65 relative to the port 67 between opened and closed positions. The diaphragm or movable wall 275 is biased so as to close the valve member 65 by a suitable spring 279 located in the chamber 273. In addition, the chamber 273 communicates through a conduit or line 281 with a central chamber 283 formed in a modulator valve 285 which is operated by the primary or flow control diaphragm 147.

More particularly, the modulating valve 285 includes a vent line or duct 287 which communicates with the central chamber 283 and with the atmosphere and which includes valve means including a vent line valve member 289 biased by a spring 291 to a closed position.

The modulating valve 285 also includes a vacuum line or duct 293 which communicates with the central chamber 283 and with the engine intake manifold 27 and which includes valve means including a vacuum line valve member 295 biased by a spring 297 to a closed position.

Extending into the central chamber 283 is a valve operating rod or actuator 301 which is fixed, at its upper end, to the primary or flow control diaphragm 147 and which, at its other end, includes an enlarged head 303 which, at one end, is engageable with the vacuum line valve member 295 to displace the vacuum line valve member 295 from the closed position in response to the occurrence of a greater vacuum condition in the air flow subchamber 153 than in the fuel flow subchamber 149. Such action communicates the vacuum motor chamber 273 with the vacuum condition in the engine intake manifold 27 so as to variably open the valve member 65 in accordance with the vacuum condition in the engine inlet manifold 27.

In the event of a greater vacuum condition in the fuel flow subchamber 149 as compared to the air flow subchamber 153, the actuator or rod 301 will shift upwardly permitting reseating of vacuum line valve member 295 in closed position and engaging the other end of the enlarged head 303 with the vent line valve member 289 so as to open the vent line or duct 287. Such action communicates the interior of the vacuum motor chamber 273 with the atmosphere and permits closure of the fuel flow control valve 65 by the spring 279. It is noted that the enlarged head 303 has a length somewhat less that the distance between the vent line valve member 289 and the vacuum line valve member 295 so as to provide a minor amount of lost motion.

As in the FIG. 1 construction, the venturis measuring air flow and gaseous fuel flow are sized so that the vacuum signal from each is equal at the desired ratio of air flow to gaseous fuel flow. When the vacuum condition in the air flow subchamber 153 is greater in amount than the vacuum condition in the fuel flow subchamber 149, the actuator or rod 301 moves to open the vacuum line valve member 295 so as to communicate the vacuum at the engine inlet manifold 27 to the vacuum motor 271 and thereby to variably open the flow control valve 65 in accordance with the amount of vacuum at the engine inlet manifold 27. The flow control valve member 65 will open until the gaseous fuel flow causes a signal which balances the signal from the air flow, at which time the flow control diaphragm 147 moves to the center position, closing the modulator valve 285 which holds the vacuum motor stationary. If the gaseous fuel flow should increase, the flow control diaphragm 147 moves the modulator valve 285 to vent the vacuum motor 271, which action closes the flow control valve member 65 and thereby decreases the gaseous fuel flow until the proper amount which causes a balance across the control diaphragm 147.

If desired, a position detector can be used to measure the position of the flow control diaphragm 147 without contact, which detector could be employed with a solenoid controlled modulator valve in an appropriate electrical circuit.

Various of the features of the invention are set forth in the following claims.

I claim:

1. A gaseous fuel and air supply system for an internal combustion engine, said system comprising an air-fuel mixing chamber, an air supply duct communicating with said mixing chamber and with the atmosphere and including sensing means for sensing pressure representative of the flow of air through said air supply duct, flow control means adapted to communicate with a source of pressurized gas, being operable between open and closed positions, and being biased toward said closed position, a fuel supply duct extending between said flow control means and said mixing chamber and including sensing means for sensing pressure representative of the flow of fuel through said fuel supply duct, and means communicating with said sensing means in said air supply duct and with said sensing means in said fuel supply duct for controlling operation of said flow control means between said open and closed positions in response to pressure sensed by said sensing means.

2. A system in accordance with claim 1 wherein said means for operating said flow control means is operable to displace said flow control means toward said open position in response to a relatively increasing vacuum condition in said air supply duct and is operable to displace said flow control means toward said closed position in response to a relatively increasing vacuum condition in said fuel supply duct.

3. A system in accordance with claim 1 wherein said means for operating said flow control means comprises a closed chamber, a control diaphragm within said chamber dividing said chamber into a first subchamber communicating with said sensing means in said air supply duct and a second subchamber communicating with said sensing means in said fuel supply duct.

4. A system in accordance with claim 3 wherein said flow control means includes a valve member movable between open and closed positions and wherein said means for operating said flow control means further includes a linkage connecting said valve member and said control diaphragm for movement of said valve member in response to movement of said control diaphragm.

5. A system in accordance with claim 3 wherein said system further includes a third subchamber located in one of said first and second subchambers and including a secondary diaphragm movable relative to a position operably causing said control diaphragm to close said flow control means, means biasing said secondary diaphragm toward said position, and means communicating with said third subchamber and adapted for communication with the engine intake manifold so as to displace said secondary diaphragm away from said position against the action of said biasing means in response to engine operation.

6. A system in accordance with claim 3 wherein said flow control means comprises a valve member movable between open and closed positions, and wherein said means for operating said flow control means also comprises a vacuum motor connected to said valve member for displacing said valve member between open and closed positions, said vacuum motor biasing said valve member to said closed position when said vacuum motor is not subject to a vacuum condition, and means for selectively applying a vacuum condition to said vacuum motor comprising a modulating valve including a flow chamber communicating with said vacuum motor, vent means communicating with said flow chamber and with the atmosphere and including vent valve means biased to a closed position, vacuum means communicating with said flow chamber and adapted for communication with an engine intake manifold and including vacuum valve means biased to a closed position, and means operably connected to said control diaphragm and to said vent and vacuum valve means for selective opening thereof in response to control diaphragm movement.

7. A system in accordance with claim 1 wherein said system further includes a first pressure reducing stage adapted for communication with a source of relatively high pressure gaseous fuel, and a second pressure reducing stage communicating between said first pressure reducing stage and said flow control means.

8. A system in accordance with claim 1 wherein said flow control means includes means for adjustably regulating the bias closing said flow control means.

9. A system in accordance with claim 1 wherein each of said sensing means comprises a venturi having a throat and a pressure tap communicating with said venturi throat.

10. A system in accordance with claim 1 wherein said system further includes a carburetor including an air induction passage having an inlet end, a venturi, and a throttle, and wherein said mixing chamber communicates with said inlet end of said induction passage.

* * * * *